US011503897B2

(12) United States Patent
Dyer

(10) Patent No.: US 11,503,897 B2
(45) Date of Patent: Nov. 22, 2022

(54) PERSONAL FLUID DISPENSING APPLICATOR AND MASSAGING TOOL

(71) Applicant: Annie Dyer, Chicago, IL (US)

(72) Inventor: Annie Dyer, Chicago, IL (US)

( * ) Notice: Subject to any disclaimer, the term of this patent is extended or adjusted under 35 U.S.C. 154(b) by 19 days.

(21) Appl. No.: 16/953,912

(22) Filed: Nov. 20, 2020

(65) Prior Publication Data

US 2021/0298456 A1 Sep. 30, 2021

Related U.S. Application Data

(60) Provisional application No. 62/994,948, filed on Mar. 26, 2020.

(51) Int. Cl.

| | |
|---|---|
| ***A45D 40/26*** | (2006.01) |
| ***A45D 40/00*** | (2006.01) |
| ***A45D 34/04*** | (2006.01) |

(52) U.S. Cl.

CPC ..... *A45D 40/26* (2013.01); *A45D 34/04* (2013.01); *A45D 2040/0006* (2013.01); *A45D 2200/1081* (2013.01); *A45D 2200/15* (2013.01); *A45D 2200/207* (2013.01)

(58) Field of Classification Search

CPC ..... A45D 40/26; A45D 34/04; A45D 2040/0006; A45D 34/042; A45D 40/262; A45D 2200/15; A45D 2200/155; A45D 2200/1009; A45D 2200/207; A45D 2200/108

USPC ..... 401/6, 261, 265

See application file for complete search history.

(56) References Cited

U.S. PATENT DOCUMENTS

| | | | | |
|---|---|---|---|---|
| 2,162,907 A * | 6/1939 | Bambach | A46B 11/0027 401/172 |
| 2,802,604 A * | 8/1957 | Ebberts | B65D 35/40 222/207 |
| 3,214,783 A * | 11/1965 | Perry | A47K 5/122 401/28 |
| 5,088,849 A * | 2/1992 | Johnson | A45D 34/04 401/47 |
| 5,908,256 A * | 6/1999 | Bernstein | A45D 34/04 401/23 |
| 6,412,997 B2 * | 7/2002 | Berke | A45D 34/04 401/206 |
| 6,726,385 B1 * | 4/2004 | Borowski | A46B 11/002 401/187 |
| 7,503,715 B2 * | 3/2009 | Khubani | A61H 7/005 401/6 |

(Continued)

*Primary Examiner* — David J Walczak

(74) *Attorney, Agent, or Firm* — Brennan, Manna & Diamond, LLC

(57) ABSTRACT

An applicator device for applying moisturizers, lotions, ointments, oils or the like to various body parts and difficult to reach areas, such as the back area, posterior area of legs, or the like. The device eliminates the need for assistance from any other individual for applying lotion over difficult to reach areas, and can help prevent or be used to treat rashes, dryness, eczema, psoriasis, and other serious conditions afflicting the skin. The device features an elongated handle attached to an applicator head having apertures for dispensing a solution onto the body of the user. The device includes a compartment for storing a solution in a specific amount and a push button mechanism to activate dispensing of the stored solution from the device.

10 Claims, 3 Drawing Sheets

(56) References Cited

U.S. PATENT DOCUMENTS

2005/0201811 A1* 9/2005 Russell ..... A45D 34/042
401/6

* cited by examiner

PERSONAL FLUID DISPENSING APPLICATOR AND MASSAGING TOOL

CROSS-REFERENCE TO RELATED APPLICATION

The present application claims priority to, and the benefit of, U.S. Provisional Application No. 62/994,948, which was filed on Mar. 26, 2020 and is incorporated herein by reference in its entirety.

FIELD OF THE INVENTION

The present invention relates generally to the field of body moisturizing tools. More specifically, the present invention relates to an improved moisturizing hand tool that can be used to apply moisturizer, lotion, ointment, etc. to all areas of the body, including those areas that are difficult to reach. In one embodiment, the moisturizing hand tool has an elongated gripping handle, and a flat oval head connected to the elongated handle, wherein the flat oval head comprises a compartment for receiving and storing lotion, ointment, and/or other moisturizers or solutions, and the compartment is secured via a screw on or snap on cap. Additionally, the oval head has numerous small apertures on its bottom surface from which the lotion that is stored in the compartment is dispensed when a push button present on the gripping handle is pressed. Accordingly, this disclosure makes specific reference thereto. Nonetheless, it is to be appreciated that aspects of the present invention are also equally applicable to other like applications, devices and methods of manufacture.

BACKGROUND OF THE INVENTION

By way of background, people often use and apply various types of lotions, oils, ointments, moisturizers or other similar liquids to various parts of the body. Lotions and skin creams are applied to the body to treat a variety of ailments including, but not limited to, skin dryness, burns, skin diseases and other ailments. They may also be applied to the skin as a proactive measure to, for example and without limitation, cleanse the skin, keep the skin moist, change the complexion of the skin, etc. Unfortunately, it is oftentimes difficult for a person to apply lotions, moisturizers or ointments to certain parts of their own body, such as their back, the posterior areas of their legs, and other hard to reach locations. People may have to put themselves in uncomfortable positions to reach their back and other hard to reach areas. For example, when attempting to apply skin products to difficult to reach areas of the body, many users may strain their necks or backs, which can result in injury, pain and/or frustration. Further, this becomes impossible for people who suffer from physical ailments that limit their bending and stretching capabilities. The difficulty in applying lotions to the back or other posterior areas of the body leads to either the uneven application of the lotion, or no application at all. Lack of moisturized skin may cause eczema, psoriasis, and other serious health conditions, which further contributes to the individual's discomfort.

Additionally, elderly, physically limited individuals and others may have to ask for assistance from another person when desiring to apply lotion to a hard to reach area, which can be embarrassing for both the individual requesting the assistance and the individual providing the same. Also, it is oftentimes difficult to apply the lotion or other solution in public areas since areas of the skin typically need to be exposed in order to apply the lotion. Therefore, the solution of asking for assistance in applying the lotion to hard to reach areas is not always possible and/or practical to implement.

Many attempts to overcome the existing problems in applying moisturizers, ointments, medicants or the like have been made in the state of the art. For example, lotion dispensers with an elongated body or extensions have been employed in an effort to reach hard to reach areas such as the back, posterior area of the legs, etc. However, while such elongated body lotion dispensers may dispense lotions at or near the desired area, the same do not properly apply the lotion over the back portion or other body parts due to the localized dispensing. Moreover, many conventional lotion applicator devices oftentimes require a user to pour some lotion on the applicator pad or end, and then use the device to apply the poured lotion to the skin by moving the applicator end across the body area. However, once the poured lotion is consumed during the application, the user then has to pour a new amount of lotion on the applicator pad or end to apply the same to the body. The process of pouring the lotion on the applicator end again and again is frustrating, wasteful, and causes great inconvenience to the user.

Furthermore, conventional lotion applicator devices often require a separate lotion or other solution to be carried along apart from the applicator device. Therefore, if the user forgets to bring both the applicator and the separate lotion, the user is deprived of the opportunity to apply the lotion, which could lead to the health ailments described above. Conventional lotion applicator devices are of little use to the individual without the accompanying lotion, and vice versa.

Therefore, there exists a long felt need in the art for a lotion applicator device that overcomes the above-noted shortcomings, is easy and convenient to use, and reduces user frustration. There is also a long felt need in the art for a lotion applicator device that assists the user in applying moisturizer, oil, sunscreen, ointment, soap, medicants or the like on hard to reach body parts, and thereby helps to prevent or treat skin ailments such as dryness, rashes, allergies, eczema, psoriasis, and other serious conditions. Moreover, there is a long felt need in the art for a lotion applicator device that does not require a user to pour the lotion, oil, cream or soap, on to the head or pad of the device prior to each individual application, and that is both portable and compact. Additionally, there is a long felt need in the art for a lotion applicator device that provides a compartment for refilling the lotion once the lotion inside the compartment is exhausted, and that is capable of applying the lotion, solution or ointment evenly and thoroughly over any desired portion of the body. Finally, there is a long felt need in the art for a lotion applicator device that is relatively inexpensive to manufacture, and that may also serve as a massaging tool.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some concepts in a simplified form as a prelude to the more detailed description that is presented later.

The subject matter disclosed and claimed herein, in one embodiment thereof, comprises a moisturizer applicator product having an elongated gripping handle that is attached to a head. The head has a plurality of apertures for dispensing moisturizer or other solutions from a compartment that is inside the applicator head. The compartment is secured via a screw on or snap on cap. The moisturizer applicator includes a push button mechanism on the elongated handle for dispensing the moisturizer stored in the compartment through the plurality of apertures on demand. The moisturizer applicator of the present invention allows a user to easily apply moisturizers, lotions and other solutions over the body without having to put limbs in awkward, difficult or uncomfortable positions. Additionally, the apertures on the head of the moisturizer applicator enables a user to also massage body portions in addition to the application of the moisturizer. Further, the moisturizer applicator tool comprises a cover for the applicator head to protect the plurality of apertures when not in use, and to prevent drying up of the dispensed moisturizer. Finally, the improved moisturizer applicator device of the present invention comprises an adjustable length handle for using the applicator device to reach different portions of the body with minimal effort.

In an alternative embodiment, the subject matter disclosed and claimed herein comprises a personal applicator product that has an elongated gripping handle, which is attached to a head. At least one side of the head is further comprised of a plurality of apertures in fluid communication with a compartment. The compartment receives and stores moisturizer, ointment, medicant and/or other lotions or solutions, and is secured via a screw on or snap on cap. The applicator product further comprises a push button or other actuating mechanism positioned along the elongated handle for dispensing the solution stored in the compartment through the plurality of apertures in the head upon demand. The applicator product of the present invention allows a user to easily apply a solution over the body without having to put limbs in awkward, difficult or uncomfortable positions. Additionally, the plurality of apertures on the head of the applicator product enables a user to separately massage body portions while simultaneously applying a moisturizing or other solution as well.

The subject matter disclosed and claimed herein, in another embodiment thereof, comprises an applicator product having an elongated telescopic handle and an applicator head attached to a distal end of the handle. The applicator head includes a compartment to store a quantity of moisturizer, and has a plurality of apertures on the applicator head in fluid communication with the compartment for dispensing the moisturizer or other solutions stored within the compartment. A push button or other actuator is used for dispensing the solution or moisturizer over the body of the individual using the applicator, and a screw on or snap on cap for accessing and refilling the compartment is provided along with a cover for the applicator head for protecting the apertures when not in use to prevent drying up of the solution contained within the applicator.

In a further embodiment of the present invention, a method to easily apply moisturizer, lotion, ointment, sunscreen, cream, soap, medicants or any other similar product to areas of the body that are otherwise difficult to reach is disclosed. The method employs the personal applicator product of the present invention and comprises the steps of initially holding a handle of the lotion applicator device from a gripping end, and then pushing a button placed on the handle for dispensing the solution stored in a compartment of the product. Next, the moisturizer or solution is dispensed over a body portion through a plurality of apertures located on the applicator head that are in fluid communication with the compartment. Once the compartment is emptied, the user accesses and refills the compartment or reservoir with additional moisturizer or solution. The user may then again evenly apply and spread the moisturizer as desired by moving the applicator head in different directions to cover various areas of the body, all the while also massaging the user's skin.

In a still further embodiment of the presently described invention, an interchangeable head applicator is provided. The interchangeable head applicator comprises a plurality of applicator heads, with each of the applicator heads having a reservoir and a first and second side. A handle for use with each of the applicator heads is also provided, wherein the handle has a telescoping configuration for lengthening and shortening the length thereof. Further, each of the plurality of applicator heads has a different dispensing pattern of nozzles or apertures.

In yet a further embodiment of the presently described invention, a system for dispensing a solution to a body is presented, and includes a supply of solution having a viscosity ranging from 10 to about 10,000 centipoises. A plurality of applicator heads is included as part of the system, wherein each of the applicator heads has at least one nozzle or aperture for dispensing a desired amount of solution. A handle is provided with an individual applicator head attached to a distal end of the handle, and a proximate end of the handle includes a hand grip area. Each of the plurality of applicator heads dispenses different viscosities of solution.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
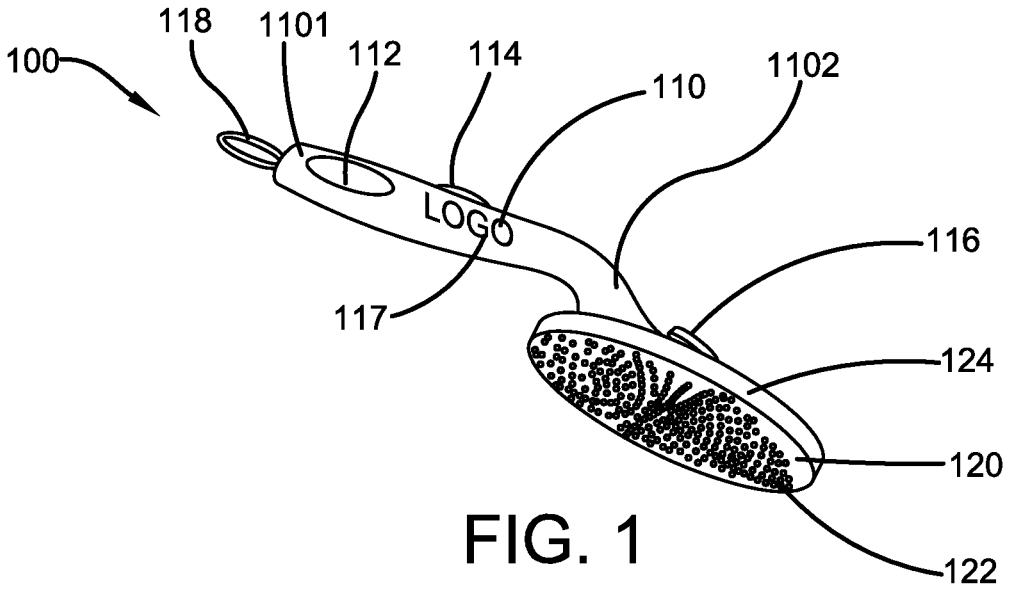
FIG. 1 illustrates a perspective view of one potential embodiment of the personal applicator device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are neither intended as an exhaustive description of the invention nor do they limit the scope of the invention. Additionally, an illustrated embodiment need not have all the aspects or advantages shown. Thus, in other embodiments, any of the features described herein from different embodiments may be combined.

Figure 6A:
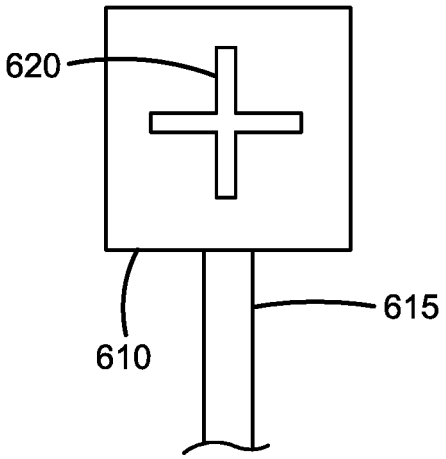
FIG. 6A illustrates a perspective view of one potential embodiment of an interchangeable applicator head that can be used with the personal applicator device of the present invention in accordance with the disclosed architecture.
Figure 6B:
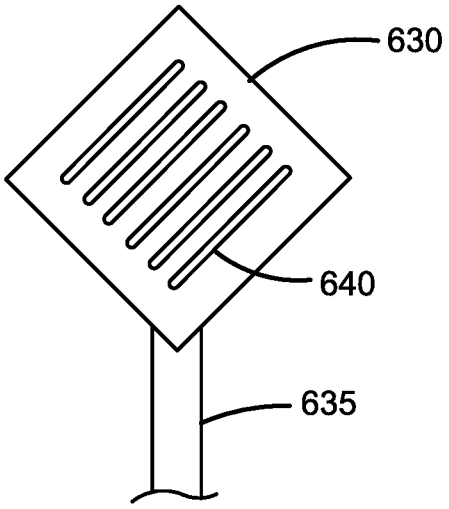
FIG. 6B illustrates a perspective view of an alternative embodiment of an interchangeable applicator head that can be used with the personal applicator device of the present invention in accordance with the disclosed architecture.

Referring initially to the drawings, FIG. 1 illustrates a perspective view of one potential embodiment of the personal applicator device 100 of the present invention in accordance with the disclosed architecture. More specifically, the applicator device 100 is comprised of an elongated handle 110, an applicator head 120, a plurality of apertures 122, a compartment or reservoir 124 inside the applicator head 120, a screw-on or snap on cap 116, a push button or other actuator 114, a gripping portion 112, and a hanging loop 118 for hanging the applicator device 100 from a hook when it is not in use. Nonetheless, the present invention further contemplates having multiple interchangeable applicator heads as will be discussed infra and are illustrated in FIGS. 6A and 6B, which allow an individual 500 to apply solutions and lotions having different viscosities so as to avoid clogging the apertures of one type of applicator head, or having too much solution or lotion supplied through too large of an aperture or nozzle opening.

In one embodiment, the elongated handle 110 is a generally tubular or cylindrical shaped structure having a proximal end 1101 and a distal end 1102 that provides an extended structure to the moisturizer applicator device 100 for applying and spreading moisturizer to difficult to reach areas of the user body. The handle 110 includes a telescopic structure for adjusting the length of the applicator tool 100 to reach difficult areas of the body, and therefore provides an easier method for applying moisturizers, lotions, ointments, medicants or the like. In one embodiment of the present invention, the elongated handle 110 of the device 100 may have a length in a range 1 to 3 feet. The handle 110 may be telescopic and the length of the device 100 can be adjusted as per the user requirements. In an alternate embodiment, the handle 110 can be of fixed length.

The gripping portion 112 is an area that is provided over the proximal end 1101 of the handle 110 for gripping or handling by the user. The gripping portion 112 may be a gripping hand around the proximal end 1101 of the handle 110, and may be made up of a non-slip material or have any gripping pattern to enable a user to secure the applicator device 100 in his or her hand while applying moisturizer or lotion over the body, particularly if the applicator device 100 is being used in a shower or bath wherein the handle may become wet or slick. In one embodiment of the present invention, the handle 110 may have a texture or groove pattern to facilitate an improved gripping surface during use, which is particularly useful when spreading lotion or similarly viscous liquid.

The push button or other actuator 114 may be positioned at the proximal end 1101 of the handle 110 for enabling the user to easily operate the button 114 while holding the handle 110 through the gripping portion 112. Other mechanisms such as touch button, clicker, or the like may be utilized in the present invention for activating the device 100 to dispense the solution from the compartment or reservoir 124 of the applicator head 120 of the device 100. When the push button 114 is pressed by a user, a stopping layer or other blockage placed inside a bottom portion of the compartment 124 is repositioned or opened, thereby placing the plurality of apertures 122 in fluid communication with the compartment 124 and allowing the solution stored within the compartment 124 to flow to and through the plurality of apertures 122. When finished dispensing the solution from the device 100, the user may press the button 114 again to break the fluid communication between the compartment 124 and the plurality of apertures 122 and stop the flow or dispensing of the solution from the device 100. Nonetheless, the operation of the device 100 of the present invention is not so limited, and other dispensing structures and methods including, without limitation, a pump-based, plunger-based, and/or gravity fed dispensing unit may also be utilized for dispensing the moisturizer or other solution from the compartment 124 to and through the plurality of apertures 122.

In one embodiment, the applicator head 120 is preferably an oval shaped structure comprised of the compartment or reservoir 124 for receiving and storing the solution until needed. The applicator head 120 is attached to, or integrally formed with, the distal end 1102 of the handle 110 of the device 100. Nonetheless, the shape of the applicator head 120 is not so limited, and other shapes, sizes and configurations may also be used including, without limitation, elliptical, circular, diamond, square, or the like. Moreover, the applicator head 120 may be fixed or removably attached to the distal end 1102 of the handle 110. The front surface 1201 or skin contacting surface of the applicator head 120 has a plurality of apertures 122 for dispensing the solution stored inside the compartment or reservoir 124. The apertures 122 may include flexible projections for enabling a massage operation to also be performed by the applicator device 100. In a preferred embodiment, the plurality of apertures 122 are positioned in a generally concentric and spaced apart manner over the front surface 1201 of the application head 120, and substantially cover between 50 and 80% of the surface area of the front surface 1201 of the applicator head 120. Nonetheless, other patterns of the apertures 122 may also be employed, and the surface feature on the front surface 1201 of the applicator head 120 is not limited to just apertures 122. For example, the pattern may be one of a concentric circles, a random pattern, a cross, a linear line, a linear pattern, or a combination thereof. Indeed, other surface features and aperture 122 layouts are also contemplated, as described further below.

For example, the skin-contacting surface 1201 may be formed by one or more of the same or different surface features. More specifically, the surface features, such as apertures 122, may be the same or of different sizes, types (e.g., protrusion, recess, aperture or others) or shapes (e.g., elliptical, circular, diamond, square, zig-zag). The surface features may also be selected or configured to facilitate the transfer and/or application of the personal care product being dispensed therefrom, such as a moisturizer, lotion, ointment or the like. The interior of the compartment 124 may further be coated with silicone (not shown) or another material to improve flow and dispensing rates of the lotion or solution to be dispensed therefrom.

The handle 110 and the applicator head 120 of the applicator device 100 may be comprised of any suitable and durable material including, without limitation, a plastic, metal, wood, etc. Further, the device 100 may be of any color, such as red, blue, green, black, white or other as per the requirements of the user, and may further comprise a logo 117 thereon or other patterns, designs, customized slogans, or the like.

The hanging loop 118 is attached to the proximal end 1101 of the handle 110 for hanging the applicator device 100 on a hook or a wall, when the applicator device 100 is not in use. The hanging loop 118 enables the user to easily store the applicator device 100 without occupying much space. Alternatively, the handle 110 may have an opening on the proximal end 1101 to hang the device 100 on a wall mounted hook for storage when the device 100 is not used.

Figure 2:
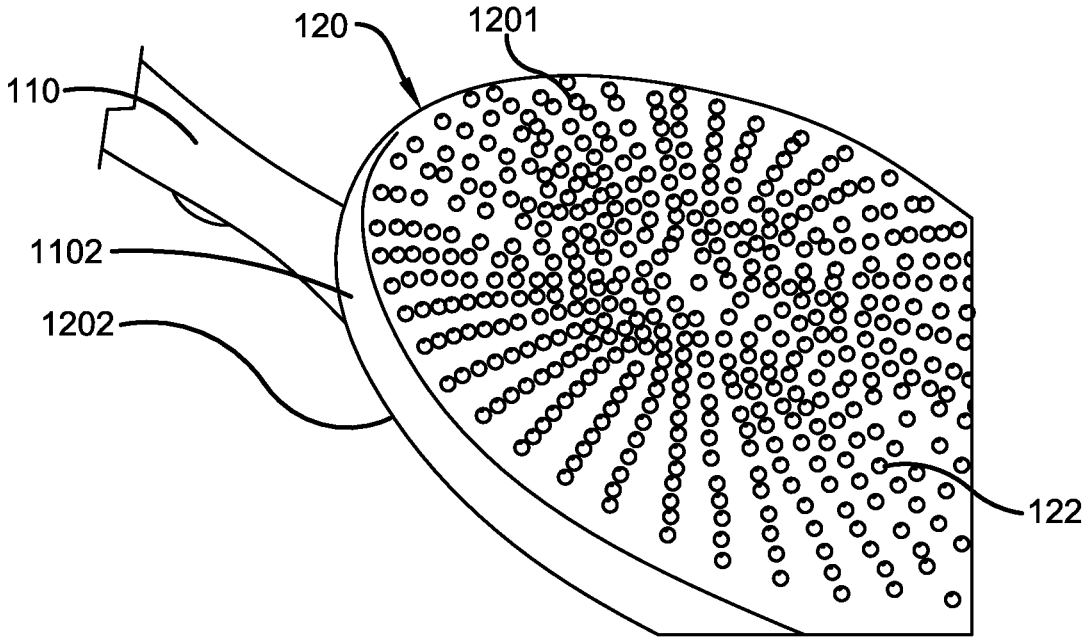
FIG. 2 illustrates a partial perspective view of one potential embodiment of the applicator head of the personal applicator device of the present invention in accordance with the disclosed architecture, wherein the plurality of apertures are visible.

FIG. 2 illustrates a partial perspective view of one potential embodiment of the applicator head 120 of the personal applicator device 100 of the present invention in accordance with the disclosed architecture, wherein the plurality of apertures 122 are clearly visible. More specifically, the applicator head 120 includes a front surface or skin contacting surface 1201 and a rear surface 1202. The front surface 1201 has a plurality of apertures 122 in small beads or protruding structures in which the apertures 122 are in fluid communication with the lotion or solution stored inside the compartment or reservoir 124 of the applicator head 120. As previously described, once the push button or actuator 114 on the handle 110 is activated by the user, the apertures 122 dispense the solution from the compartment or reservoir 124 evenly over the head of the applicator and then on to the skin of the user in contact with the front surface 1201 of the applicator head 120. For reference purposes, the front surface 1201 refers to the portion of the device 100 that is meant to contact the user's skin, and the back or rear surface 1202 refers to the opposite side of the applicator head 120.

As previously stated, in one embodiment of the present invention, the apertures 122 may include protrusions with each protrusion having a relatively soft tip for enabling a massage operation by the applicator device 100. The apertures 122 are preferably positioned in a concentric manner over the front surface 1201 of the application head 120, though other patterns of the apertures 122 may also be employed as per the requirements or preferences of the user. Additionally, the surface feature on the front surface 1201 of the applicator head 120 is not limited to apertures 122, and other surface features may also be employed.

Moreover, the skin-contacting surface 1201 may be formed by one or more of the same or different surface features. For example, the apertures 122 may be the same or of a different size, type (e.g., protrusion, recess, aperture or others), or shape (e.g., elliptical, circular, diamond, square, zig-zag). The surface features may be selected and configured to facilitate the transfer and/or application of the personal care product, such as moisturizer, lotion, ointment or the like onto the skin of the user. In a further embodiment, the applicator head 120 may have vibration sensors which may be activated with the push button 114 or other activating mechanism for providing a massage operation of the moisturizer applicator 100. The applicator head 120 may also include one or more heating elements 302 (see e.g., FIG. 3) by which heat can be applied to the area receiving the massage treatment.

Figure 3:
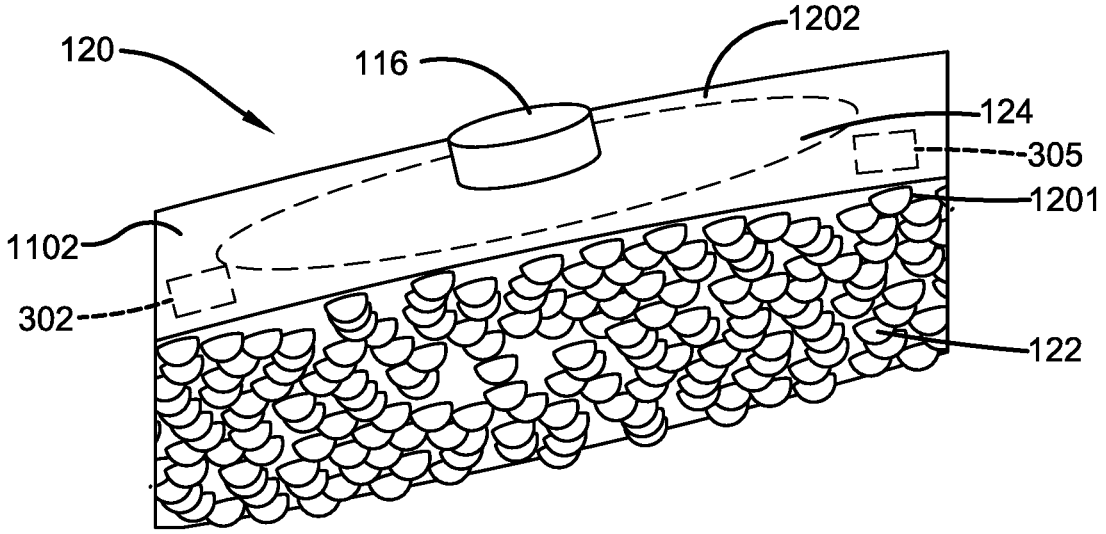
FIG. 3 illustrates a partial side perspective view of one potential embodiment of the applicator head of the personal applicator device of the present invention in accordance with the disclosed architecture, wherein the cap closure is visible.

FIG. 3 illustrates a partial side perspective view of one potential embodiment of the applicator head of the personal applicator device of the present invention in accordance with the disclosed architecture, wherein the cap closure 116 is visible. More specifically, the applicator head 120 includes a screw-on or snap on cap 116 that is attached to the back surface 1202 of the applicator head 120, opposite the side of the apertures 122. The screw-on or snap on cap 116 is preferably a circular shaped cap having a threaded internal structure for enabling a user to open the compartment 124 by rotating the cap 116 in a counter-clockwise direction, and allows the user to close the compartment 124 by rotating the cap 116 in a clockwise direction, or vice versa. The size of the cap 116 ranges from a one-sixth portion of the front surface to the full front surface of the applicator head 120, and the cap 116 may be comprised of a plastic, metal, or any other suitable material which prevents the flow of the moisturizer or other solution stored within the compartment 124.

The user accesses the compartment 124 by opening the cap 116, and may fill any moisturizer, lotion, ointment, sunscreen, massage oils, medicants or other solutions inside the compartment or reservoir 124 of the applicator head 124. Once the compartment 124 is filled with the required amount of moisturizer, solution or the like, the user can then place the cap 116 over the opening on the back surface 1202 of the applicator head 120 to seal the compartment 124. As previously stated, the applicator head 120 may further comprise one or more heating elements 302 or vibratory devices to add additional comfort to the individual user. The applicator head 120 may include a battery compartment 305 to provide power to drive the vibratory feature or to activate the heating element 302.

The compartment 124 is a holding tank adapted to hold approximately 5 oz. of a solution, or roughly the amount of material required to complete at least five full body applications of the solution. Nonetheless, the capacity of the compartment 124 is not so limited, and other compartment 124 sizes can also be utilized, while keeping the applicator device 100 compact and portable. The viscosity of the solutions dispensed by the apertures 122 of the applicator head 120 range from 10 centipoise (oils) to about 10,000 centipoise (pastes and ointments), such that there is sufficient fluid movement and egress of the solution from the applicator head 120. The solution may be selected from one of a moisturizer, a lotion, an ointment, a sunscreen, a cream, a soap, a medicant, and a combination thereof.

Figure 4:
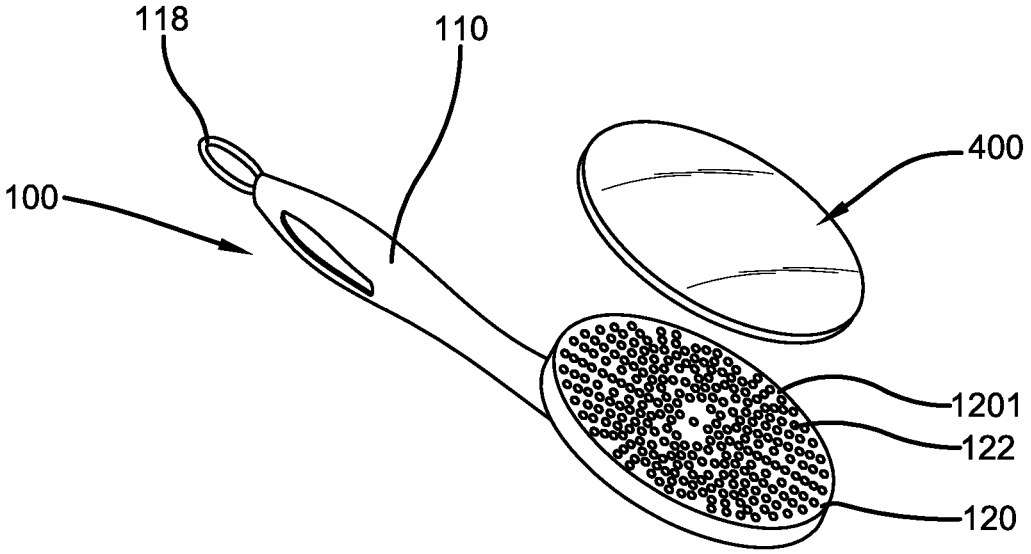
FIG. 4 illustrates a perspective view of one potential embodiment of the personal applicator device of the present invention in accordance with the disclosed architecture, wherein a cover for the plurality of apertures is visible.

FIG. 4 illustrates a perspective view of one potential embodiment of the personal applicator device 100 of the present invention in accordance with the disclosed architecture, wherein a cover 400 for the plurality of apertures 122 is visible. More specifically, the applicator device 100 preferably comprises a cover 400 for covering the front surface 1201 of the applicator head 120 when not in use. Accordingly, the size and shape of the cover 400 correspond to the size and shape of the applicator head 120, or are slightly larger than the same. The cover 400 prevents drying up of the moisturizer, lotion, solution or the like that is dispensed through the apertures 122 and contained in the reservoir or compartment 124, and can be attached to the applicator head 120 when the device 100 is not in use by screw-on mechanism, push mechanism or any other known attachment means. The cover 400 is preferably comprised of a transparent or translucent plastic. However, the material and appearance of the cover 400 is not so limited, and the same may be comprised of any other suitable material.

Figure 5:
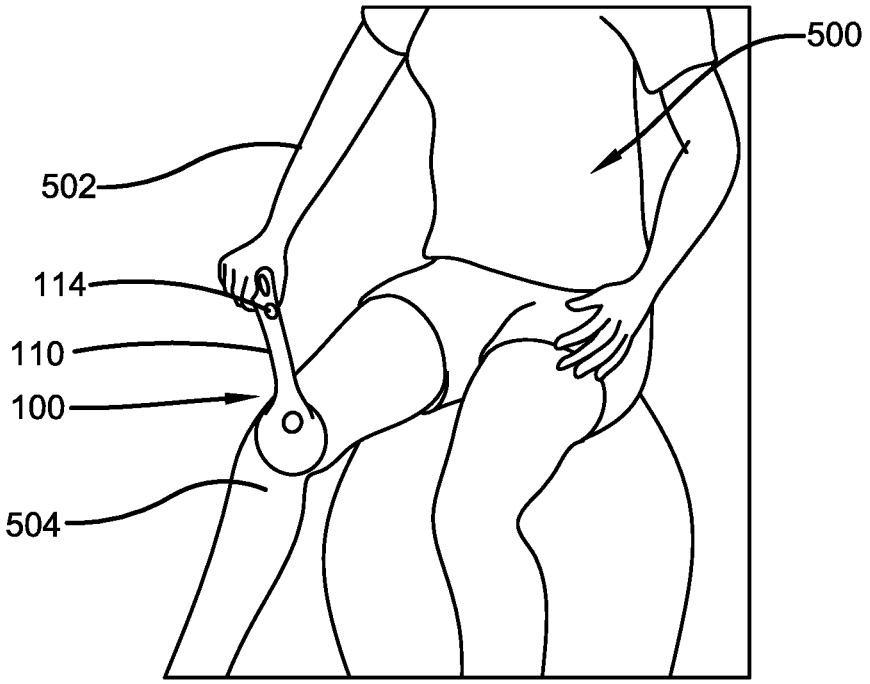
FIG. 5 illustrates a perspective view of one potential embodiment of the personal applicator device of the present invention in accordance with the disclosed architecture, wherein the device is being used by an individual.

FIG. 5 illustrates a perspective view of one potential embodiment of the personal applicator device 100 of the present invention in accordance with the disclosed architecture, wherein the device 100 is being used by an individual 500. More specifically, the individual 500 holds the handle 110 of the applicator device 100 in his or her hand 502 along the gripping portion 112, and presses the push button or other actuator 114 near the proximal end of the handle 110. When activated, moisturizer, lotion or another solution stored in the compartment 124 is dispensed through the plurality of apertures 122 located on the front surface 1201 of the applicator head 120. The user 500 then places the applicator device 100 over, for example, a leg area 504 to apply the moisturizer over the legs 504 and other nearby areas. The applicator head 120 of the present invention applies the moisturizer smoothly and evenly with a gentle massaging action. After use, the user 500 may cover the applicator head 120 with the cover 400 to prevent the remaining moisturizer from drying out, and may hang the device 100 to dry using a mounting or hanging loop 118 attached to the handle 110 of the device 100.

FIG. 6A illustrates a perspective view of one potential embodiment of an interchangeable applicator head 610 that can be used with the personal applicator device 100 of the present invention in accordance with the disclosed architecture. More specifically, the applicator head 610 is comprised of a roughly square shaped head having a generally cross shaped aperture or nozzle 620 to dispensing the fluid or solution. In use, the applicator head 610 with its specially designed aperture 620 may dispense a solution with a higher viscosity, which may have otherwise clogged the apertures 122 of the applicator head 120 described above. Further, the applicator head 610 may be connected by the handle 615 to the telescoping handle 110 by any known means.

FIG. 6B illustrates a perspective view of an alternative embodiment of an interchangeable applicator head 630 that can be used with the personal applicator device 100 of the present invention in accordance with the disclosed architecture. More specifically, the applicator head 630 provides a different shaped configuration and a different set of apertures or nozzles 640 disposed in a linear manner for dispensing a fluid of an intermediate viscosity. Applicator head 630 may connect to the telescoping handle 110 by the handle 635. By providing a plurality of different interchangeable applicator heads, an individual 500 can dispense different viscosities of solution without clogging the nozzles or apertures 122, 620, 640, etc., thereby allowing the individual to use different products and treatments.

The moisturizer applicator device 100 of the present invention is convenient to use, compact, and portable. It also enables the user 500 to easily apply moisturizers and other solutions to the back and other difficult to reach areas of the body without assistance from a third party. The applicator device 100 is perfect for applying medicinal creams and/or ointments as well. The device 100 can be utilized by the common user in a simple and effortless manner, with little or no training. The device 100 of the present invention is simple in construction, economical to manufacture, and easy and efficient to use.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "Moisturizer applicator device", "Moisturizer applicator", "Moisturizer applicator product" and "Applicator device" are interchangeable and refer to the Moisturizer applicator device 100 of the present invention. As used herein, the terms "moisturizer" and "liquid" include gels, creams, pastes, foam, liquids, solid-liquid mixtures and mists which are known to be dispensed by various hand-sized pump and spray dispensers.

Notwithstanding the forgoing, the moisturizer applicator device 100 of the present invention can be of any suitable size and configuration as is known in the art without affecting the overall concept of the invention, provided that it accomplishes the above stated objectives. One of ordinary skill in the art will appreciate that the size, configuration and material of the moisturizer applicator device 100 and its various components as shown in the FIGS. are for illustrative purposes only, and that many other sizes of the moisturizer applicator device 100 and its various components are well within the scope of the present disclosure. Although the dimensions of the moisturizer applicator device 100 are important design parameters for user convenience, the moisturizer applicator device 100 may be of any size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An interchangeable personal substance applicator device comprising:

a plurality of applicator heads, each of the plurality of applicator heads comprising a reservoir, a first side, and a second side, a plurality of apertures, and a heating element; and a handle for use with each of the plurality of applicator heads, wherein the handle is comprised of a telescoping configuration and attached to a select one of the plurality of applicator heads, and further wherein each of the applicator heads has a different dispensing pattern of apertures; and wherein the plurality of apertures each comprise a flexible soft massaging protrusion extending away from the front side.

2. The interchangeable personal substance applicator device as recited in claim 1, wherein the reservoir contains a solution having a viscosity ranging from 10 to 10,000 centipoises.

3. The interchangeable personal substance applicator device as recited in claim 2, wherein the solution is selected from one of a moisturizer, a lotion, an ointment, a sunscreen, a cream, a soap, a medicant, and a combination thereof.

4. The interchangeable personal substance applicator device as recited in claim 2, wherein the handle is comprised of a button to dispense the solution from the reservoir.

5. The interchangeable personal substance applicator device as recited in claim 1, wherein a pattern of apertures is provided on each of the plurality of applicator heads, and further wherein the pattern of apertures is one of a concentric circles, a random pattern, a cross, a linear pattern or a combination thereof.

6. The interchangeable personal substance applicator device as recited in claim 1, wherein the select one of the plurality of applicator heads is attached to a distal end of the handle and a proximate end of the handle is comprised of a hand grip area.

7. A system for dispensing a solution to a body comprising:

a supply of solution having a viscosity ranging from 10 to 10,000 centipoises;

a plurality of applicator heads, wherein each of the plurality of applicator heads comprises a plurality of apertures for dispensing an amount of the supply of solution, and wherein the plurality of apertures each comprise a flexible soft bead extending outwardly; and a handle attached to a select one of the plurality of applicator heads on a distal end of the handle, wherein a proximate end of the handle comprises a hand grip area, and further wherein each of the plurality of applicator heads is capable of dispensing different viscosities of solution; and wherein each of the applicator heads further comprises a vibratory element for massaging a user.

8. The system for dispensing solution to a body as recited in claim 7, wherein a pattern is provided on each of the plurality of applicator heads.

9. The system for dispensing solution to a body as recited in claim 7, wherein each of the plurality of applicator heads has a heating element.

10. The system for dispensing solution to a body as recited in claim 9, wherein the heating element and the vibratory element are powered by a battery.

* * * * *